US008925832B2

(12) United States Patent
Gschwind et al.

(10) Patent No.: US 8,925,832 B2
(45) Date of Patent: Jan. 6, 2015

(54) METHOD OF CLEANING A SPRAY DEVICE

(75) Inventors: Michel Gschwind, Grasse (FR); Fabien Guerrin, Grasse (FR); Frederic Richard, Grasse (FR)

(73) Assignee: Areco Finances et Technologie—Arfitec, Grasse (FR)

( * ) Notice: Subject to any disclaimer, the term of this patent is extended or adjusted under 35 U.S.C. 154(b) by 278 days.

(21) Appl. No.: 13/498,820

(22) PCT Filed: Sep. 30, 2010

(86) PCT No.: PCT/FR2010/052072

§ 371 (c)(1),
(2), (4) Date: May 25, 2012

(87) PCT Pub. No.: WO2011/039487

PCT Pub. Date: Apr. 7, 2011

(65) Prior Publication Data

US 2012/0234937 A1 Sep. 20, 2012

(30) Foreign Application Priority Data

Sep. 30, 2009 (FR) ..... 09 56815

(51) Int. Cl.

| | |
|---|---|
| ***B05B 1/24*** | (2006.01) |
| ***B08B 9/08*** | (2006.01) |
| ***B08B 17/00*** | (2006.01) |

(52) U.S. Cl.

CPC .. *B08B 9/08* (2013.01); *B08B 17/00* (2013.01)

USPC ..... 239/13; 239/4; 239/102.2; 239/106; 239/110; 239/120; 239/128; 239/135; 239/67; 239/71; 239/550; 239/566

(58) Field of Classification Search

USPC ..... 239/4, 13, 102.1, 102.2, 104, 106, 110, 239/120, 128, 135, 67, 71, 73, 74, 523, 550, 239/566, 596

See application file for complete search history.

(56) References Cited

U.S. PATENT DOCUMENTS

| | | | | |
|---|---|---|---|---|
| 3,445,961 | A * | 5/1969 | Elsworth | 239/102.2 |
| 3,591,091 | A * | 7/1971 | Galloway et al. | 239/523 |
| 4,340,176 | A * | 7/1982 | Bernard | 239/135 |

FOREIGN PATENT DOCUMENTS

| | | |
|---|---|---|
| EP | 1 820 910 A2 | 8/2007 |
| FR | 2 788 706 A1 | 7/2000 |

(Continued)

OTHER PUBLICATIONS

Appendix 1 of the Nov. 30, 2005 Amending the Decree of Jun. 23, 1978 Relating to Fixed Installations for Heating and Hot Water Supply to Residential Building, Working Premises or Premises Open to the Public, NOR: SANP0524385A, published on Dec. 15, 2005 (with translation).

(Continued)

*Primary Examiner* — Steven J Ganey
(74) *Attorney, Agent, or Firm* — Oliff PLC

(57) ABSTRACT

The device for diffusing sprayed liquid in a reception zone includes a vessel suitable for containing a liquid for spraying and at least one diffuser of sprayed liquid that is arranged in the vessel. The diffuser includes in particular an ultrasound emitter. The cleaning method is such that during a stage of operation of the device in which the device is not diffusing liquid in the reception zone, the following steps are performed: heating a liquid in the vessel up to a predetermined temperature, preferably higher than 60° C., in particular lying in the range 65° C. to 80° C.; and draining the liquid from the vessel via a pipe of the device that is situated outside a circuit for diffusing sprayed liquid in the reception zone.

13 Claims, 3 Drawing Sheets

(56) References Cited

FOREIGN PATENT DOCUMENTS

| | | |
|---|---|---|
| FR | 2 866 572 A1 | 8/2005 |
| FR | 2 875 718 A1 | 3/2006 |

OTHER PUBLICATIONS

Feb. 3, 2011 International Search Report issued in International Patent Application No. PCT/FR2010/052072 (with translation).

May 28, 2010 French Preliminary Search Report issued in French Patent Application No. 0956815 (with translation).

Feb. 3, 2011 Written Opinion of the International Searching Authority issued in International Patent Application No. PCT/FR2010/052072 (with translation).

* cited by examiner

METHOD OF CLEANING A SPRAY DEVICE

FIELD OF THE INVENTION

The invention relates to devices for spraying liquid.

BACKGROUND OF THE INVENTION

Such devices are used in particular for hydrating consumable produce set out on displays, in particular in supermarkets. By way of example, the produce may be fruit and vegetables.

Such devices comprise a vessel of liquid and spray heads arranged in the vessel, each head comprising a nozzle containing the liquid from the vessel and an ultrasound emitter suitable for emitting ultrasound waves into the liquid in order to spray it.

The liquid for spraying is generally water coming from a conventional mains water network.

However, as a function of the quality of the water and also of the quality of the surrounding air, the device is liable to become dirtied repeatedly. In particular, biofilms, i.e. films formed by bacteria at the surface of the water, are liable to appear in the vessel. These films constitute pockets encouraging the development of bacteria that, on being inhaled, are potentially harmful for man, e.g. *Legionella*. The development of such bacteria must be controlled in order to avoid them being projected into ambient air. Furthermore, internal development of the population of bacteria is encouraged by certain increases in the temperature of the water (the ideal temperature for the development of *Legionella* lies in the range 25° C. to 45° C.), by adding a volume of contaminated water, or indeed by injecting contaminated air. More generally, the dirt that accumulates in the device can lead to malfunctioning.

The operations needed for cleaning the device are relatively burdensome and may require the machine to be dismantled, at least in part. This also applies when it is desired to clean the machine after it has been stopped for a long period of time.

Object and Summary of the Invention

An object of the invention is to enable the device to be cleaned effectively, by eliminating biofilms and most microorganisms, while avoiding operations that are too burdensome.

To this end, the invention provides a method of cleaning a device for diffusing sprayed liquid in a reception zone, the device comprising a vessel suitable for containing a liquid for spraying and at least one sprayed liquid diffuser arranged in the vessel, the diffuser comprising in particular an ultrasound emitter, the method being such that, during a stage of operation of the device in which the device is not diffusing liquid in the reception zone, the following steps are implemented:

- heating a liquid in the vessel up to a predetermined temperature, preferably higher than 60° C., in particular lying in the range 65° C. to 80° C.; and
- draining the liquid from the vessel via a pipe of the device situated outside a circuit for diffusing sprayed liquid in the reception zone.

Thus, cleaning makes use of thermal action in the form of a thermal shock that enables the device to be decontaminated.

It does not require burdensome or time-consuming actions, such as a step of mechanical cleaning by rubbing with a brush. There is no need to dismantle the device even in part, nor even to open it. Such a method can thus be implemented more frequently than can a conventional cleaning method.

It may be implemented making use solely of elements that are incorporated in the device, in particular a heater device.

Using such a method, it is easy to eliminate biofilms. Thin biofilms are destroyed when subjected to high temperature. Since the method of the invention can be repeated frequently, e.g. every day, without significantly increasing maintenance costs, thick biofilms do not have the time to build up. Such a method thus enables them to be eliminated and prevents them from developing, and it does so in a manner that is simple and effective.

Since biofilms are eliminated, the development of bacteria is slowed down or even prevented. Furthermore, the thermal cleaning method eliminates the bacteria, at least in part and possibly completely. For example, provision may be made for the method to implement pasteurization. A temperature higher than 60° C. makes it easy to eliminate bacteria, in particular by pasteurization, without any need to heat for too long a period of time.

Furthermore, since the liquid is drained from the vessel after the step of heating it, the residue of biofilms that might remain in the water that has been used for cleaning is discharged from the device, thereby providing better hygiene for the display. Draining the liquid away from the spraying circuit leading to the reception zone, avoids any risk of contaminating the spraying circuit.

The method of the invention is very advantageous since it makes it possible to avoid the device becoming clogged. In addition, it serves to eliminate bacteria, such as Legionella, thereby avoiding contaminating consumers with such bacteria.

Since the method is performed while the device is not diffusing liquid on the reception zone, there is no fear of interference with said zone nor with articles that receive the sprayed liquid in normal operation. It follows that it is possible to select parameters for implementing the method without constraint, such as heating temperature, heating duration, number of heating cycles, etc. This also limits the power needed for heating the liquid.

The method may also be automated so that it is implemented without human intervention.

Preferably, the pipe communicates directly with the vessel.

The method of the invention may also comprise one or more of the following characteristics:

- A sensor is used to determine whether the temperature of the liquid is higher than the predetermined temperature, and heating is operated as a function of this determination, in particular heating is stopped when the temperature is higher than the predetermined temperature. In this way, better control is achieved over the expenditure of energy needed for cleaning the device. Preferably, care is taken to ensure that the device does not exceed a maximum temperature that can be withstood by its components, in particular the pump and the ceramics of the diffusers, where present.
- The temperature of the liquid is maintained in a predetermined range for a predetermined duration, preferably greater than or equal to 2 minutes, and in particular lying in the range 5 minutes to 60 minutes. This ensures that all bacteria are properly eliminated.
- A level of liquid in the vessel is measured using at least one level sensor, and heating is controlled as a function of the measured level. This cleans the device once the vessel is suitably filled so as to eliminate a maximum amount of biofilm, regardless of where the biofilm is located. Biofilm forms in the air/water boundary zone and is therefore more frequent in the upper portion of the vessel.

The liquid is caused to circulate in the vessel, e.g. by using a pump situated therein, in particular once the liquid has reached a predetermined level in the vessel. In certain complex types of installation, this makes it possible to ensure that the liquid used for cleaning flows through all of the elements of the vessel and to guarantee complete cleaning of the device. The device does not necessarily include a circulation pump.

During another stage of operation of the device in which the device diffuses the liquid in the reception zone, the liquid is caused to circulate in the vessel at a circulation rate such that the ratio of said rate divided by the delivery rate of the diffuser(s) is greater than or equal to 50. By way of example, the circulation rate is the delivery rate of the above-mentioned pump. Thus, the bacteria content is low at all times in the diffusers so the nebulization action is effective in destroying the bacteria, as from the beginning of operation.

During another stage of operation, the liquid is diffused in the reception zone without the liquid previously being heated in the vessel up to the predetermined temperature, preferably without the liquid previously being heated in the vessel. This is the normal or nominal operation of the device. It can be seen that the cleaning method does not interfere with this operation in any way.

The method is repeated periodically, e.g. once every 24 hours.

The reception zone includes articles that are sensitive to temperature, such as foodstuffs.

The invention also provides a device for diffusing sprayed liquid in a reception zone, the device comprising:

a vessel suitable for containing a liquid for spraying;

at least one diffuser of sprayed liquid that is arranged in the vessel;

heater means, such as a heater resistance element, arranged in the vessel, preferably closer to a bottom of the vessel than to a top of the vessel;

a pipe situated outside a circuit for diffusing sprayed liquid in the reception zone and communicating, preferably directly, with the vessel; and control means for use during a stage of operation of the device in which the device is not diffusing liquid in the reception zone to cause the liquid contained in the vessel to be heated to a predetermined temperature, preferably higher than 60° C., in particular lying in the range 65° C. to 80° C., and to cause the liquid to be drained from the vessel via the pipe.

It is easier to heat the liquid if the heater device is placed close to the bottom of the vessel because of the slightly lower density of the hot liquid.

Preferably, the diffuser comprises an ultrasound emitter, preferably presenting an inside face that tapers on approaching an orifice of the diffuser.

The Applicant has observed, surprisingly, that such a face forming an acoustic concentrator for improving the effectiveness of spraying, also increases the elimination of germs and bacteria such as Legionella. This concentrator, combined with the thermal action of the method, further improves the bactericide effect of the method. The safety of the device is thus considerably enhanced.

Such a heater device may comprise at least one heater resistance element, of simple design and enabling heating to be effective, with it also being easy to control the operation of such an element.

Advantageously, the device further comprises a sensor suitable for measuring the temperature of the liquid and/or for determining whether the temperature of the liquid contained in the vessel is greater than a determined temperature, and/or at least one level sensor serving to determine whether the liquid contained in the vessel has reached a predetermined level, the control means preferably being suitable for causing the heater device to operate as a function of at least one signal provided by the level sensor and/or the temperature sensor.

Thus, the device of the invention may also include at least one temperature sensor arranged in the device in such a manner as to be suitable for measuring the temperature of the liquid and/or for determining whether the temperature of the liquid contained in the vessel is higher than a determined temperature.

It may comprise two temperature sensors, one of the sensors being for measuring the temperature of the liquid and the other being a safety sensor for ensuring that the liquid does not exceed a critical temperature.

It is possible to provide for the heater elements to be of the positive temperature coefficient (PTC) type. That is a thermistor of resistance that increases steeply with increasing temperature in a limited temperature range but decreases outside it. This has the advantage of avoiding any need for a temperature sensor.

In an embodiment of the invention, the device also includes at least one level sensor for determining whether the liquid contained in the vessel has reached a predetermined level.

Such a device may comprise in particular two level sensors, one sensor determining a maximum level for liquid and another sensor determining a minimum level for liquid.

The control means may be suitable for controlling the heater device as a function of signals supplied by the level sensor and/or the temperature sensor, thereby enabling the method to be controlled better.

The device may also include a clock, the device then also being capable of including means for controlling the heater device as a function of signals supplied by the clock.

BRIEF DESCRIPTION OF THE DRAWINGS

The invention can be better understood on reading the following description given purely by way of example and made with reference to the drawings, in which.

MORE DETAILED DESCRIPTION

The description begins with a device in a first embodiment of the invention and an associated method. Thereafter a method is described in another implementation of the invention, that may be associated with a device that is simpler, such a device not including a pump for circulating the liquid in the vessel.

Figure 1:
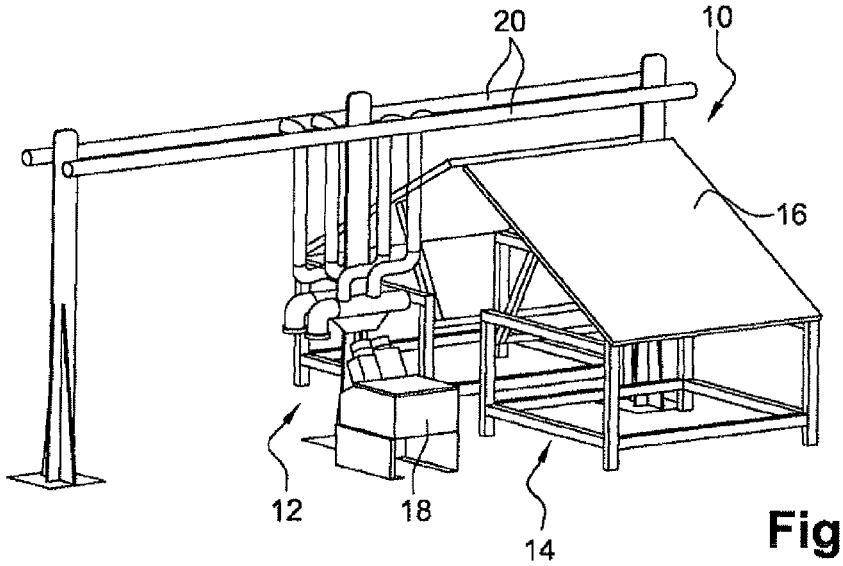
FIG. 1 is a perspective view of a display including a spray device in an embodiment of the invention.

Reference is made initially to FIG. 1 which shows a display 10 including a spray device 12 in an embodiment of the invention, and a stand 14 for housing articles that are sensitive to temperature, e.g. consumable foodstuffs such as fruit and vegetables, seafood, etc. The stand includes in particular a plate 16 for carrying the articles.

The device is for spraying droplets of water within a reception zone comprising the display so that the comprises in particular a generator 18 suitable for nebulizing the liquid that is to be sprayed onto the consumable produce, which liquid is constituted by water, and pipes 20 receiving the nebulized liquid and taking it to the vicinity of the consumable produce. The pipes 20 then include orifices for allowing the liquid to be diffused onto the consumable produce. This constitutes a circuit for spraying water on the articles.

Figure 2:
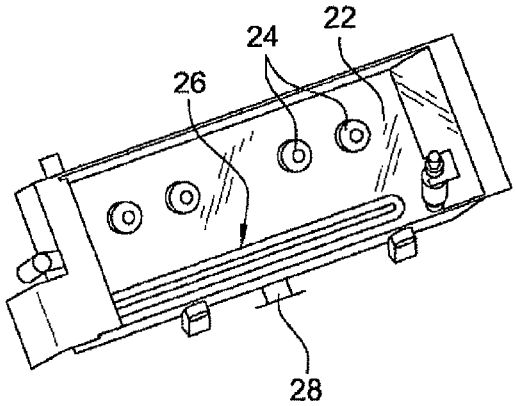
FIG. 2 is a perspective view of a vessel of a FIG. 1 diffusion device.
Figure 5:
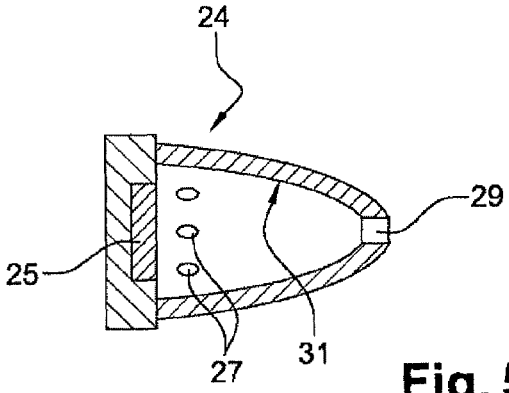
FIG. 5 is an axial section view of a diffusion head of the FIG. 1 device.
Figure 3:
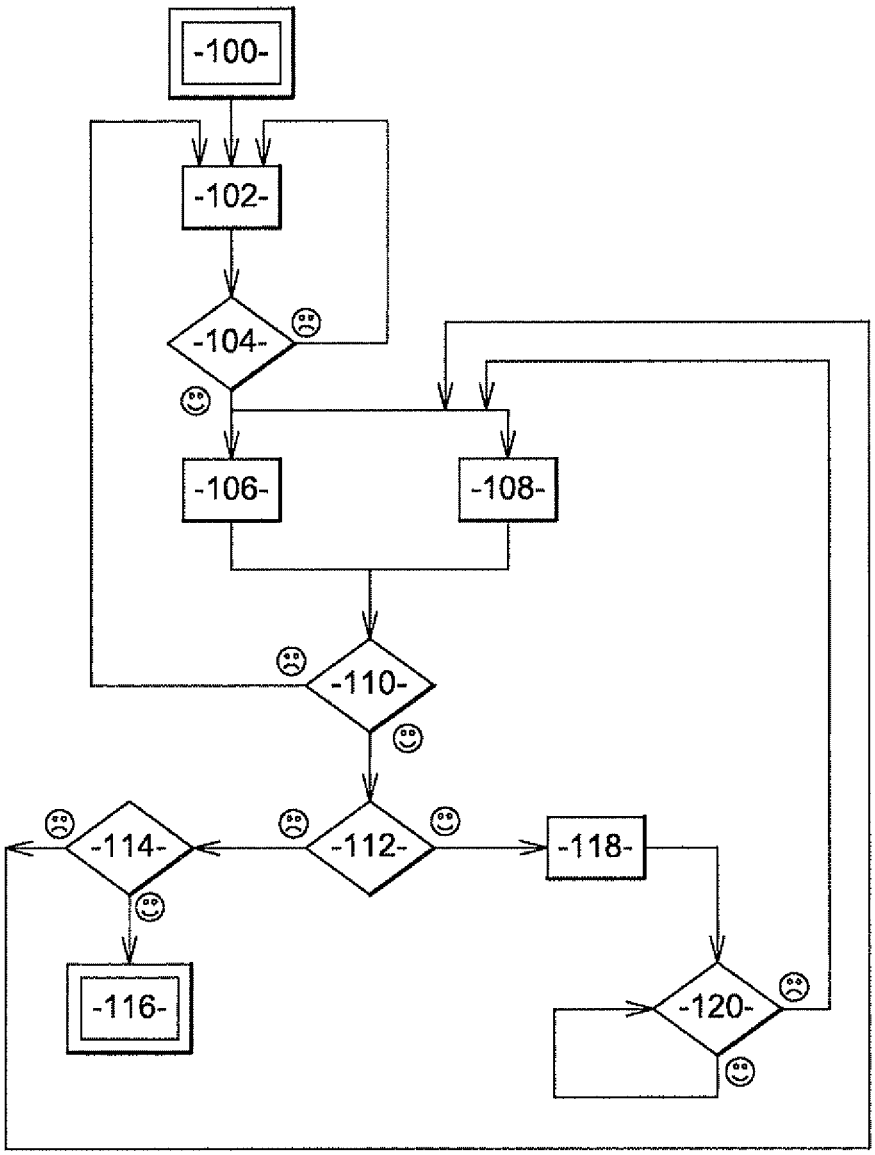
FIG. 3 is a flow chart of a method in a first implementation of the invention, performed using a device such as that shown in FIG. 2.

There follows a description in greater detail of the generator 18. As can be seen in FIG. 2, it comprises a vessel 22 for receiving the liquid for projecting onto the consumable produce, and spray heads 24 arranged within the vessel 22. As shown in FIGS. 2 and 5, each spray head 24 comprises a nozzle containing the liquid to be sprayed and in fluid communication with the vessel, and an ultrasound emitter 25 for nebulizing the liquid contained in the nozzle. The emitter in this example comprises a piezoelectric ceramic. The nozzle presents orifices 27 for admitting water into the nozzle. The droplets that are formed escape via an outlet orifice 29 of the nozzle. Provision may be made for the heads to be immersed in the liquid in the vessel, or on the contrary for them to extend above the level of the liquid.

The inside face 31 of the nozzle is of a shape that tapers going towards the orifice of the diffuser, e.g. a shape having a parabolic profile and forming a surface of revolution about the longitudinal axis of the nozzle. This form thus constitutes an acoustic concentrator. Greater detail on this topic can be found in application FR-2 788 706.

The generator includes means for filling the vessel, e.g. comprising a valve connected to a filter device itself connected to the main water network.

As can be seen in FIG. 2, the generator also includes a heater device 26 constituted by a heater resistance element. By way of example, and as shown in the figures, it may be U-shaped, extending over a major fraction of the long dimension of the vessel in order to heat it more effectively. Specifically, power of 200 watts (W) is supplied.

The generator also includes two level sensors arranged in the vessel, these sensors not being shown in the figure. They are situated at two levels in the vessel referred to as being a minimum level and a maximum level for liquid in the vessel. The minimum level generally corresponds to the level at which the ultrasound emitter is only just covered in water, with the heater elements then also being covered in water. The maximum level is a level above which the vessel runs the risk of overflowing via an overflow pipe, e.g. a level corresponding to 80% of the total capacity of the vessel. Filling the vessel up to this level, as described below, also makes it possible to clean the overflow zone.

The generator also has two temperature sensors. The first temperature sensor is constituted by a temperature probe for measuring the temperature of the liquid in the vessel 22. This probe is arranged inside the vessel and is not shown in the figures.

The second temperature sensor 28 forms a safety sensor, such a sensor being constituted in this example by a bimetallic strip comprising two strips of metal having different temperature coefficients that are bonded together. Such a sensor serves to send an electric signal when the temperature exceeds a threshold temperature.

The generator also comprises a pump for causing the liquid in the vessel 22 to circulate. Thus, the temperature of the liquid is more uniform, since all of the liquid passes close to the heater element 26. In addition, using the pump serves to clean all of the portions of the device that are in contact with the water.

The generator also includes a circuit for controlling the heater element 26, the circuit comprising means for powering the element electrically and means for controlling the power supply to the heater element, e.g. using one or more switches, with the one or more switches being controlled as a function of signals coming from the level and/or temperature sensors. The heater element control circuit also includes a clock, since it is also possible for the switch(es) to be actuated as a function of signals received from the clock. By way of example, these control means are electronic or computer control means responding to an appropriate computer program suitable for implementing the method.

There follows a description of the method of cleaning a spray device of the kind described.

The method begins in a step 100 when the clock reaches a predetermined time, this time being a time during which the device does not operate to project liquid onto the consumable produce, e.g. nighttime at 2:00 AM. The method is implemented when the spray heads are deactivated and are not in operation. The produce may indeed be absent.

When the clock reaches the predetermined time, the means for feeding the vessel with liquid are actuated in a vessel-filling step 102.

As a function of signals supplied by the high level sensor, it is then determined whether the level in the vessel is higher than a predetermined level, in a step 104.

So long as the level determined in step 104 using the high level sensor remains below the predetermined level, the method returns to step 102 and the vessel continues to be filled.

In contrast, if the level is higher than the predetermined level, then filling is stopped and the heater element 26 is powered to begin a step 106 of heating the liquid contained in the vessel. A step 108 is also triggered for actuating the pump of the generator so as to enable the cleaning liquid to circulate through all of the elements in the vessel. Causing the liquid to circulate in the vessel enables it to be heated more uniformly.

Once the steps 106 and 108 of heating and circulating the liquid in the vessel has begun, data supplied by the low level sensor is used to determine whether the level of the vessel is below a predetermined level corresponding to the low level of the vessel, in a step 110.

If the level determined in step 110 is below the predetermined level, then the heating and circulation of the liquid in the vessel are stopped and the method returns to the step 102 of filling the vessel.

In contrast, if the level is higher than the low level, then the temperature of the liquid in the vessel is measured using the temperature probe in a step 112, and it is determined whether the temperature is higher than a predetermined temperature.

In the present example, the predetermined temperature is 70° C., which is a good temperature for cleaning the vessel, in particular for pasteurizing it, with that temperature being maintained in the liquid for a duration that is relatively short, e.g. 2 minutes, as stated in Appendix 1 of the Nov. 30, 2005 Order relating to fixed installations for heating and supplying hot tap water in dwellings, work places, or premises receiving the public (No. SANPO524385A) in accordance with French regulations.

If the temperature measured in step 112 is higher than the predetermined temperature, then the heater element is switched off in a step 118. This serves to save energy, with the heater element then not heating continuously throughout the duration of the method. This also serves to avoid the device overheating.

Once the element has been switched off, the temperature of the liquid is measured once more using the probe in a step 120.

If the temperature is higher than the predetermined temperature, i.e. 70° C., then there is a pause of a few seconds and the measurement step 120 is performed again.

Once the temperature has dropped below the predetermined temperature, the method returns to step 106 of actuating the heating step once more. The heating of the liquid is thus servo-controlled so as to maintain the liquid at a temperature close to 70° C., while avoiding any pointless expenditure of energy. More precisely, the temperature of the liquid is maintained in a predetermined range around 70° C., e.g. a range of 68° C. to 72° C.

This is done for a predetermined duration, preferably not less than 2 minutes, and in particular lying in the range 5 minutes to 60 minutes.

In step 112, if the temperature is on the contrary less than the predetermined temperature, then, in a step 114, the clock is used to verify whether a predetermined time has not been exceeded.

Under such circumstances, the predetermined time may be 2:45 AM, for example, since it has been found that operating the cleaning method for a cycle of 45 minutes can suffice to eliminate biofilms and bacteria when the predetermined temperature is a temperature of 70° C.

If the predetermined time has not been exceeded, then the method returns to steps 106 and 108, and the pump and the heater element continue to be operated.

When the predetermined time is exceeded, the method is terminated in a step 116, and all of the members of the vessel such as the heater element or the pump are switched off. The liquid that has been used for cleaning the generator is also drained away. This draining may take place under gravity through a drain valve connected to the public drainage system, for example. Drainage takes place via a pipe that does not form part of the circuit for diffusing droplets in the reception zone and that communicates directly with the vessel.

This also serves to clean the drain circuit, which it is important to do because this circuit may be a site in which bacteria develops or through which they may pass.

It should be observed that execution of the end step 116 may also be implemented as a result of the safety bimetallic strip detecting a temperature higher than its threshold temperature. The threshold temperature of this sensor is selected to be higher than the predetermined temperature so that it does not trigger the end step of the method if the probe is operating correctly. Nevertheless, it serves to stop the method in the event of the probe being faulty and in the event of the temperature of the liquid being too high. Its threshold temperature may in particular be 85° C., and it is determined by the temperature that can be withstood by the ceramic and the other components of the circuit that are in contact with the overheated liquid.

After this cleaning, preferably a few hours later, the device may return to normal operation. Thus, during another operating stage, liquid is diffused into the reception zone. This diffusion takes place without the liquid being previously heated in the vessel up to the predetermined temperature, and even without the liquid being previously heated at all in the vessel. The liquid remains cold, at ambient temperature, and/or at the temperature at which it leaves the water supply network, which temperature may be higher or lower than ambient temperature. The device has had the time to cool down completely after cleaning before restarting its operation as a diffuser in the reception zone.

However it is not necessary for restarting to take place a few hours later. Provision may be made for the device to include a temperature probe and, after cleaning, for the device to be filled with cold water. If the temperature of the water is less than a predetermined threshold, e.g. 25° C., nebulization is restarted onto the reception zone, otherwise it may be necessary to empty the vessel again and refill it with cold water once more. It is the cold water that cools the system. This characteristic also serves to ensure that the water temperature likewise does not exceed the normal operating threshold.

Figure 4:
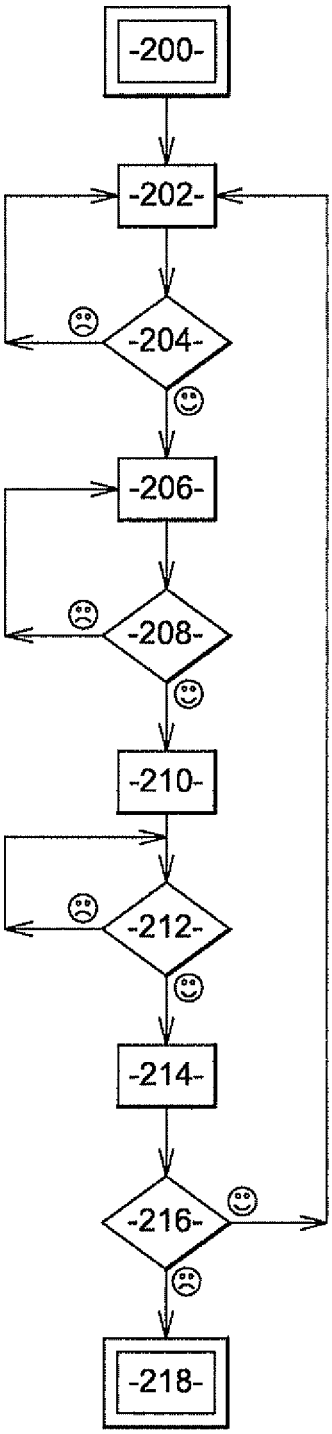
FIG. 4 is a flow chart of a method in another implementation of the invention, the method being implemented in a device of a type that is different from that of FIGS. 1 and 2.

There follows a description of another method in another implementation of the invention, as shown in FIG. 4. This method may be implemented in a device having a generator that is less complex and that does not include a pump, for example.

The method begins at an initial step 200 during which the method is started by an operator from the outside, e.g. in the morning before opening the store.

Once the method has started, the vessel is filled with liquid in a step 202, similar to the step 102, and the level of water is then determined in a step 204 similar to step 104.

So long as the level determined in step 204 using the high level sensor remains below the predetermined level, step 202 of filling the vessel is continued.

When the level becomes higher than the predetermined level, filling is stopped and the heater element is powered electrically in a step 206 for heating the liquid contained in the vessel.

During a step 208, the temperature of the liquid is then measured using a temperature probe, and it is determined whether the temperature is higher than a predetermined temperature, i.e. 70° C. in this example.

If the temperature is not higher, then the liquid continues to be heated and the method returns to the preceding step 206.

However if the orifice is higher than the predetermined temperature, a timer is started in step 210. The liquid continues to be heated at this time. It is possible to envisage reducing the power supplied to the heater element once the timer has been triggered.

Thereafter, during a step 212, it is determined whether the length of time since the timer was triggered is greater than a determined duration, e.g. 5 minutes, which is a duration that is sufficient for eliminating bacteria by pasteurization when the liquid is raised to 70° C.

If the measured time is less than 5 minutes, then the method returns to step 212 and the elapsed time is measured once more.

However if the measured time is greater than 5 minutes, then the vessel is drained using its drain means, such as a hose connected to a drain valve leading to the public drainage system, in a step 214. The heater element is also switched off.

Thereafter, in a step 216, it is determined whether this is the first draining operation.

If so, the method returns to the filling step 202 and steps 202 to 216 are performed once more.

Otherwise, it is considered that the cleaning method has come to an end.

The time interval between two cleaning cycles may advantageously be evaluated as a function of the real operation of the machine. It has been found that the ultrasound system with an acoustic concentrator is effective in destroying bacteria. However, a long period of non-operation or of operation at partial power encourages biofilms to develop. The cycles should be more frequent when the equipment is used at reduced power. Furthermore, when restarting after being stopped for a long period, the water in the filters may be contaminated to a greater or lesser extent, so it is then appropriate to rinse the filter system and to proceed with an initial thermal shock in order to ensure the quality of the water.

In the presence of the pump and while operating with nebulization over the reception zone, it is advantageous for the pump to deliver water at a rate that is high in comparison with the delivery rate of the diffuser 24. In this respect, it is preferable for the pump to deliver at 2 liters per minute and for the diffusers collectively to deliver at 1.6 liters per hour, these values not being limiting. The ratio between these delivery rates, i.e. the pump rate divided by the diffuser rate, is 75. This means that the pump constantly stirs the water much faster than the water is nebulized. This serves to dilute bacteria within the bath. The bacteria content in the diffusers is thus low at all times, such that the nebulization action is effective in destroying bacteria from the beginning of operation, because of the bactericidal effects of ultrasound. This bacteria content will naturally decrease as cleaning progresses. In this respect, it is advantageous for the above-mentioned ratio to be greater than or equal to 50, and preferably for it to be at least 60. These aspects are independent of the volume of the vessel.

If the device includes a fan for diffusing the air bearing the droplets of nebulized water, it is preferable to stop the fan during cleaning so as to avoid dissipating the heat produced by the heater element.

The device and the method are not limited to the above description.

There may thus be only one level sensor, the high level sensor, or no level sensor at all, with the end of filling then possibly corresponding to the end of a predetermined duration.

In addition, a device of the invention need not include a pump, or it may have some number of spray heads that is different from the number described.

The method may also differ from that described. The method in the first implementation may be triggered manually instead of automatically using a clock. In addition, steps 104, 108, and 110 are optional. Nor is it essential to drain the liquid from the vessel after cleaning, even though that is more hygienic.

Furthermore, after the detection step indicating that the cleaning liquid has reached the high level of the vessel, the method may include a waiting step of waiting for a suitably-chosen predetermined duration prior to stopping filling and beginning heating the liquid, which duration is preferably selected so that the cleaning liquid does not overflow from the vessel. This makes it possible for the level of liquid to exceed the air/water boundary zone where biofilms form, which zone corresponds to the high level of liquid in the vessel. This guarantees better disinfection of these zones. Under such circumstances, the nozzle of the liquid diffuser may contribute to diffusing the liquid over all of the inside surfaces of the vessel, in particular in the upper portion thereof.

The method in the second implementation may also differ from that described above. For example, it may be performed only once rather than twice, even if cleaning is then not as good. It is also possible to perform cleaning more than twice, if the cleaning needs to be even more thorough.

Furthermore, the method in the second implementation may be controlled by a clock as in the first implementation of the invention, and it may be triggered at a given time. The steps 204, 208, and 216 are likewise optional. The method in the second implementation of the invention may likewise be performed in a manner that is entirely automatic.

When the predetermined temperature is reached in this method, it is also possible to implement the method in such a manner that it includes servo-controlling the heater device, as in the first implementation of the method.

It should also be observed that the temperatures, levels, durations, or periodicities specified are not limited to those described above.

It is possible to implement the method of the invention with a predetermined temperature that is selected to be relatively high, e.g. greater than 80° C. or 90° C., such as 100° C. It is thus possible to generate steam that serves also to disinfect the pipework of the device used for conveying air. However it is then necessary to provide means such as a specific cooling circuit in order to cool certain components of the device such as the piezoelectric ceramics that cannot withstand such a temperature. Such an embodiment is therefore more onerous to implement.

The device and the method of the invention may also be used for cleaning pipes used for spraying onto the consumable produce. For example, the orifices of these pipes may be closed and filling may be controlled in such a manner that the cleaning liquid also fills the pipes. This is particularly appropriate when the device includes a pump capable of causing the liquid to circulate in a closed loop within the vessel and the pipes.

The invention can be used for devices that diffuse sprayed liquid in refrigerated window displays, e.g. containing traditional butcher's produce (meat, etc.), delicatessen, or cheese, e.g. cut or sliced at customer request.

The invention can also be used for devices that diffuse sprayed liquid in cellars for aging wine or maturing cheese, which devices operate in environments that are difficult, with bacteria or yeasts in the air.

Provision may be made to nebulize hot water over the reception zone with the device (other than when cleaning by thermal shock), e.g. with water at a temperature that may be as high as 60° C. Nevertheless, this temperature level runs the risk of damaging the nozzles so under such circumstances it is preferable to limit the duration for which hot water is nebulized to 10% of the total nebulization operating time over the reception zone.

After the device has been emptied of the water that has been heated for thermal shock, provision may also be made for the vessel to be filled with (clean) cold water at ambient temperature and/or at the temperature of the supply network from which it comes, which water is drained away immediately via the dedicated pipe in order to rinse the device appropriately so as to ensure that no residue of biofilm, bacteria, etc. remains therein. This filling and draining should be performed at least once. Thereafter, the next filling is used for normal operation for nebulizing over the reception zone. Where necessary, this rinsing also has the effect of cooling the vessel and the device prior to restarting nebulization.

The invention claimed is:

1. A method of cleaning a device for diffusing sprayed liquid in a reception zone, the method comprising:

heating a liquid in a vessel of the device up to a predetermined temperature; and draining the liquid from the vessel via a pipe of the device;

wherein:

the vessel of the device is configured to contain a liquid for spraying;

at least one sprayed liquid diffuser is arranged in the vessel;

the diffuser comprises an ultrasound emitter;

the device comprises a circuit for diffusing sprayed liquid in the reception zone;

the pipe is positioned outside the circuit; and the method is carried out when the device is not diffusing liquid in the reception zone.

2. The method according to claim 1, further comprising determining via a sensor whether the temperature of the liquid is higher than the predetermined temperature, wherein the liquid is heated as a function of the determination.

3. The method according to claim 1, further comprising maintaining the liquid at a temperature within a predetermined range for a predetermined duration.

4. The method according to claim 1, further comprising measuring via at least one level sensor a level of the liquid in the vessel, wherein the liquid is heated as a function of the measured level.

5. The method according to claim 1, further comprising circulating the liquid in the vessel.

6. The method according to claim 5, wherein the liquid circulates in the vessel via a pump.

7. The method according to claim 1, wherein the reception zone comprises articles that are sensitive to temperature.

8. A device for diffusing sprayed liquid in a reception zone, wherein the device comprises:

a vessel configured to contain a liquid for spraying;

at least one diffuser of sprayed liquid that is arranged in the vessel;

a heater device arranged in the vessel;

a circuit for diffusing sprayed liquid in the reception zone;

a pipe for draining the liquid from the vessel positioned outside the circuit; and a controller configured to control:

the heating of the liquid in the vessel to a predetermined temperature, and drainage of the liquid from the vessel via the pipe.

9. The device according to claim 8, wherein the diffuser comprises an ultrasound emitter.

10. The device according to claim 8, further comprising a one or more sensor selected from the group consisting of a temperature sensor and one or more level sensor;

wherein:

the temperature sensor is configured to measure a temperature of the liquid in the vessel and/or determine whether the temperature of the liquid in the vessel is greater than the predetermined temperature; and the level sensor is configured to determine whether the liquid in the vessel has reached a predetermined level.

11. The device according to claim 8, wherein:

the device is configured to circulate the liquid in the vessel;

the diffuser is configured to diffuse the liquid in the reception zone; and the device is configured to have a ratio of a circulation rate of the liquid in the vessel to a delivery rate of the diffuser is greater than or equal to 50:1.

12. The device according to claim 8, wherein the device is configured so that the liquid diffused in the reception zone has not been heated in the vessel up to the predetermined temperature.

13. The device according to claim 8, wherein the pipe for draining the liquid from the vessel is in direct communication with the vessel.

* * * * *